United States Patent [19]

Hademenos

[11] Patent Number: 4,926,937

[45] Date of Patent: May 22, 1990

[54] COMPOUND LINKAGE-ARM ASSEMBLY FOR USE IN BORE-HOLE TOOLS

[75] Inventor: Jim P. Hademenos, Friendswood, Tex.

[73] Assignee: Western Atlas International, Inc., Houston, Tex.

[21] Appl. No.: 363,584

[22] Filed: Jun. 8, 1989

[51] Int. Cl.[5] ..... E21B 23/00; E21B 47/00

[52] U.S. Cl. ..... 166/206; 166/66.4

[58] Field of Search ..... 166/206, 212, 113, 65.1, 166/66.4, 250, 254, 255, 104, 241; 175/285; 181/102, 103, 104, 105; 340/853; 250/268

[56] References Cited

U.S. PATENT DOCUMENTS

| | | | |
|---|---|---|---|
| 3,295,604 | 1/1967 | Cordary et al. | 175/285 X |
| 3,353,622 | 11/1967 | Erikson | 181/0.5 |
| 3,426,865 | 2/1969 | Henry | 181/0.5 |
| 3,811,529 | 5/1974 | Crawford | 181/0.5 |
| 3,978,939 | 9/1976 | Trouiller | 181/104 |
| 4,120,353 | 10/1978 | Roesner | 166/65 |
| 4,130,816 | 12/1978 | Vogel et al. | 340/15.5 |
| 4,428,422 | 1/1984 | Laurent | 166/212 |
| 4,435,978 | 3/1984 | Glatz | 166/250 X |
| 4,480,186 | 10/1984 | Wolk | 250/268 |
| 4,506,219 | 3/1985 | Lee | 324/221 |
| 4,514,809 | 4/1985 | Johnson et al. | 364/422 |
| 4,523,640 | 6/1985 | Wilson et al. | 166/64 |
| 4,549,630 | 10/1985 | Brown | 181/106 |
| 4,563,757 | 1/1986 | DeCorps | 367/33 |
| 4,575,831 | 3/1986 | DeCorps | 367/33 |
| 4,610,309 | 9/1986 | O'Brien et al. | 166/206 X |
| 4,614,250 | 9/1986 | Panetta | 181/102 |
| 4,715,469 | 12/1987 | Yasuda et al. | 181/102 |
| 4,715,470 | 12/1987 | Paulsson | 181/106 |
| 4,751,688 | 6/1988 | Paulsson | 367/36 |
| 4,757,873 | 7/1988 | Linyaev et al. | 181/105 |

*Primary Examiner*—Stephen J. Novosad
*Attorney, Agent, or Firm*—Barry C. Kane

[57] ABSTRACT

A compound linkage arm assembly for providing a substantial force to initially extend an arm assembly from a sonde without increasing the driving force in the opening mechanism. A linear drive mechanism initially acts upon a linkage within an arm assembly of the tool. The links unseat and force the arm away from the tool without much force from the drive mechanism. Once the arm is moved away from the tool by the full extension of the links, push rods act directly upon the arm to contact the bore hole wall. The advantage of this arrangement is that the linear drive mechanism is not required to exert a great amount of lateral force upon the arm to obtain the initial extension. The links acting between the arm and the sonde body provide the lateral force necessary to extend the arm. Once the links have been fully extended, the linear drive mechanism is able to act directly upon the arm the remainder of the distance since sufficient later forces are generated by the geometry between the drive, the push rod and the arm pivot points.

7 Claims, 3 Drawing Sheets

COMPOUND LINKAGE-ARM ASSEMBLY FOR USE IN BORE-HOLE TOOLS

BACKGROUND OF THE INVENTION

1. Field of the Invention

The invention relates to apparatus for urging a device against a wall of a hole and particularly to a mechanism for extending an arm and fixing the device at a desired depth within a bore hole.

2. Description of the Prior Art

In logging a well, a special tool known as a sonde is lowered into the well bore hole on a conductive armored cable. Typically the sonde is lowered to the bottom of the bore hole and raised slowly during the logging process. Occasionally the sonde is lowered to a selected depth of interest during a sampling period. To maintain the depth of the sonde, and to urge the tool against the bore hole wall for obtaining the best signal, a mechanical clamping mechanism may extend from the tool to engage the wall of the bore hole.

Several clamping mechanisms have been developed to fix a sonde within a bore hole. One mechanism previously used consists of an extension arm pivotally coupled to the sonde. A leaf spring or other biasing mechanism positioned between the sonde and the arm is used to extend the arm and force the arm away from the sonde, forcing both the sonde and the arm against the bore hole wall. Illustrative of such a mechanism is U.S. Pat. Nos. 4,614,250 and 4,575,831, both assigned to Schlumberger Technology Corporation. Several disadvantages occur with the biasing means for extending the arm. First, the force may not be sufficient to fix the sonde in place with slack in the cable. A second disadvantage may be in that the extension distance of the arm is not controllable. That is to say there is no in between distance. The arm must extend as far as the bore hole will allow.

Another mechanism often used to extend a sonde arm is a hydraulic jack. The hydraulic mechanism may be used for anchoring as well as for up-hole operations when extension of a pad or a portion of the sonde must be in contact with the bore hole wall at all times. Illustrative of a hydraulic jack extension mechanism are U.S. Pat. Nos. 4,751,688 and 4,715,470 assigned to Chevron Research Company. A disadvantage with the hydraulic jack or piston extension mechanism is the need for a fluid reservoir and pumping device. In addition, the diameter of the sonde limits the extension distance since the extension axis is generally perpendicular to the longitudinal axis of the sonde.

Yet another mechanism used to extend a clamping pad or arm may be by a linear drive mechanism. Such a mechanism is illustrated in U.S. Pat. No. 4,715,469, assigned to Petrophysical Services, Inc., a division of Western Atlas International, Inc. and the assignee of this invention. The drive mechanism may be comprised of a motor which powers a threaded shaft which retains a ball nut or truck. One end of a push rod is pivotally coupled to the ball nut. The opposite end of the push rod is pivotally coupled to the extension arm. The electric motor is reversible therefore allowing extension and retraction of the arm. The extension mechanism provides its greatest force towards the point of greatest extension. With the arm in the fully retracted position, the push rod and the extension arm are nearly parallel. In extending the arm from the closed position, the force applied by the linkage is along the length of the arm with little or no lateral force to drive the arm away from the sonde. Occasionally the clamping or extension arm may not extend because the force from the drive gear is parallel to the longitudinal axis of the arm. That is there is no lateral component to move the arm away from the sonde. In another instance, the lateral force may push the arm in towards the tool. In each case, the arm does not move away from the tool and a strain is placed upon the drive mechanism as well as on the connections between the components, leading to early fatigue and possible failure. Another disadvantage occurs in situations where the tool is used in a deviated hole and the weight of the tool is upon the arm in the closed position. The drive mechanism may be unable to produce sufficient force to open the arm and lock the tool in place in the bore hole.

SUMMARY OF THE INVENTION

The instant invention is an apparatus for extending and retracting an arm assembly with respect to a tool within a bore hole. The mechanism provides a sufficient and substantially constant force across the entire extension distance of the arm assembly to lock the sonde in place irrespective of the bore hole deviation.

In general, an arm assembly is coupled at one end to a bore hole tool. A push rod is coupled at one end to a linear drive mechanism located within the tool, and having an opposite end coupled in a partially sliding relationship near the free end of the arm. Coupled with the arm and the push rod is a pivotally coupled, compound linkage assembly. One end of the linkage assembly is pivotally coupled to the arm. A second end of the linkage assembly (linkage means) is coupled in a sliding relationship to the arm, and pivotally to the push rod. The pivot point between the two links in the assembly is located between the arm and the sonde body. The linkage mechanism provides the initial extension force to drive the arm away from the tool. At the point of the linkage's greatest extension, the push rod mechanism is able to provide sufficient direct force to the arm to extend the arm and lock the tool in place within the bore hole.

BRIEF DESCRIPTION OF THE DRAWING FIGURES

A better understanding of the benefits and advantages of my invention may be obtained from the appended detailed description and the drawings, wherein.

DETAILED DESCRIPTION OF PREFERRED EMBODIMENTS

Figure 1:
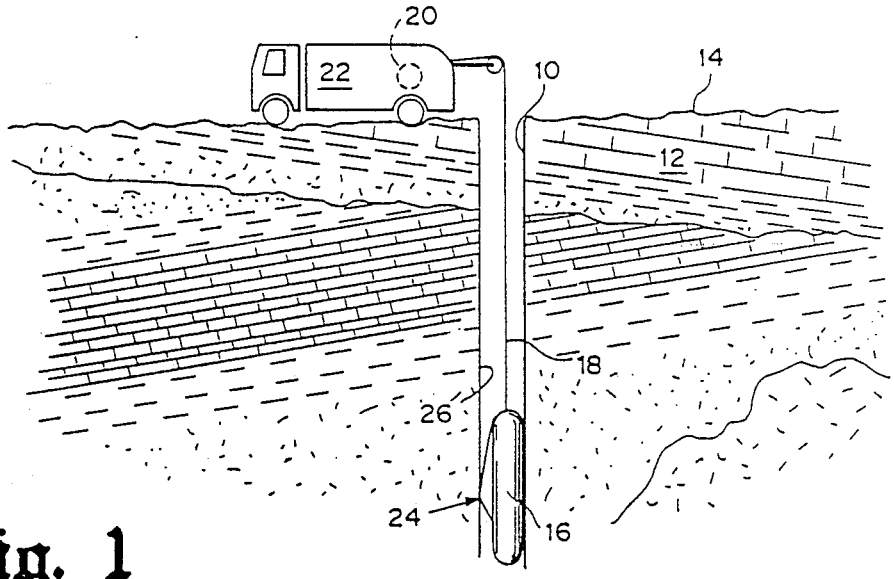
FIG. 1 illustrates a sonde suspended in a bore hole in a typical survey.

FIG. 1 illustrates a sonde suspended in a bore hole in a typical survey. As shown in the FIG., a bore hole 10 extends into the earth 12 from the surface 14. Although the bore hole is shown to be vertical, it is not unusual for the bore hole to deviate from the vertical by as much as sixty degrees, and in certain instances the bore hole may become horizontal. The tool may contain a wide variety of instruments, depending on the type of survey. Such a survey may include well logging or vertical seismic profiling (VSP) to determine the subsurface lithology. In conducting a logging or VSP survey, a sonde 16 containing generating and/or sensing devices may be lowered into the bore hole 10 by a wireline 18. The wireline is shown spooled from a reel 20 typically mounted to a truck or skid-mounted platform 22 located on the surface 14. The truck or platform 22 may also contain electronic equipment for communicating with the sonde. Once the sonde 16 is positioned at the desired depth, an arm assembly 24 may extend from the sonde, urging the sonde against the bore hole wall 26.

Figure 2:
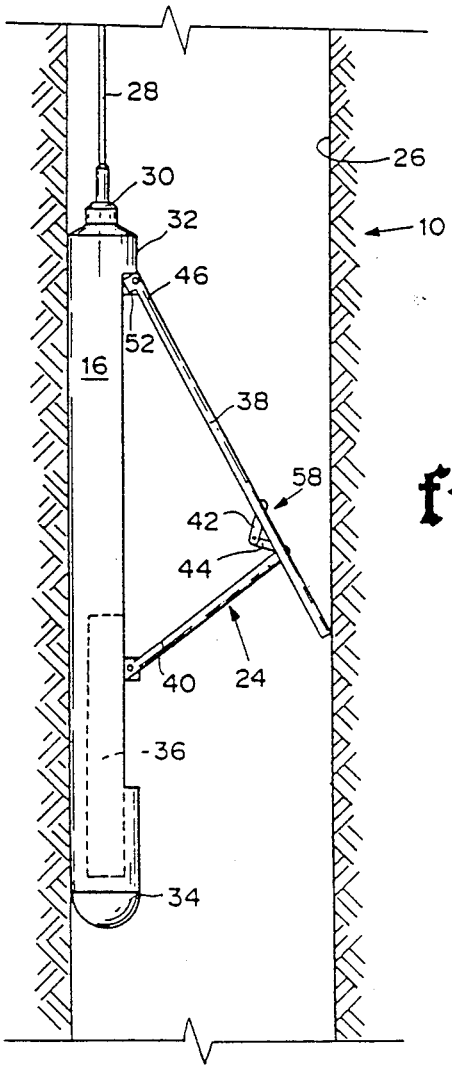
FIG. 2 is an enlarged view of a sonde employing the instant invention.

FIG. 2 is an enlarged view of a sonde employing the instant invention. The sonde 16 is suspended in the bore hole by an electrically conductive wireline 28 coupled to an upper connector member 30 which is connected to a housing 32. The housing 32 may comprise the main body of the sonde which may retain a majority of the tool components. Such components may include transducers, radioactive sources, sensors, and electrical or hydraulic motors. The types of sensing and signal generating components within a sonde are the subject of other patents and publications and will not be described herein. The lower end of the housing 32 may terminate in a connector used to couple additional tools in tandem. However, in this FIG. the end of the sonde is capped (34) to protect the end of the housing and to assist in guiding the tool past obstacles or minor deviations in the bore hole.

Located approximately midway along the exterior of the housing 32 may be the arm assembly 24 mounted in the side of the sonde 16. The outer portion of the arm assembly may form an integral portion of the housing exterior. In the embodiment of FIG. 2, the arm assembly may be actuated by a reversible drive mechanism or means 36 (shown in phantom) which extends and retracts the arm with respect to the housing 32. For example only and not be way of limitation, it is preferred that the drive mechanism be similar to the one described in U.S. Pat. No. 4,715,469, incorporated herein by reference. The drive mechanism may be of any design (hydraulic, mechanical, electrical, pneumatic, etc.) which will provide sufficient force in both directions to operate the arm.

Figure 3:
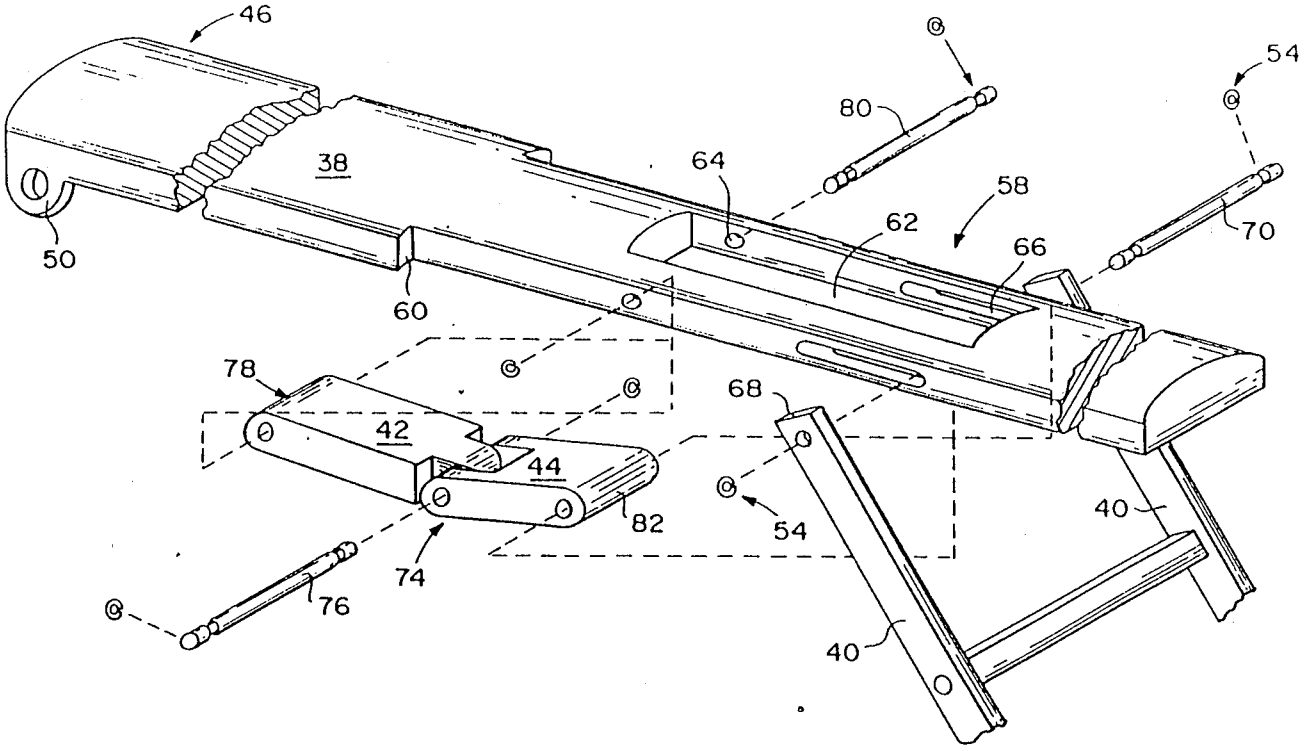
FIG. 3 is an exploded view of the instant invention.

Referring to both FIGS. 2 and 3, the arm assembly 24 may be comprised of an arm 38, a pair of push rods 40 and links 42 and 44. The arm 38 is preferably constructed from stainless steel or other high strength, corrosive-resistant material and may vary in length. The arm 38 is preferably coupled at one end 46 to the sonde housing 32. The coupling is pivotal in nature and may be effected by a variety of fasteners. For example and not by way of limitation, the coupling may be made by a pin 48 passing through hinge tabs 50 defined at the end 46 of the arm 38 and received in a lug 52 defined at the end of the housing 32. The pin 48 may be retained in the hinge by snap rings or c-clips 54 received in grooves 56 at each end of the pin. The opposite end 58 of the arm 38 is coupled in a pivotal and sliding relationship to a pair of push rods 40 which in turn are connected to the drive mechanism 36.

FIG. 3 is an exploded view of the instant invention. The arm may be substantially rectangular in transverse cross-section and it is preferred that the outer surface be slightly convex. The radius of the outer surface should preferably conform to that of the tool when the arm is fully retracted. The width is greatest in the upper half of the arm. Approximately midway along the arm, the arm width is reduced at shoulder 60 to provide sufficient space for the coupling of the push rods 40 to the arm 38. Defined within the arm 38 is at least one cut-out 62 and as many as two or more such cut-outs may be defined along the longitudinal axis of the arm. By way of example, cut-out 62 is shown towards the lower portion 58 of the arm. Each cut-out passes through the shortest dimension of the arm. Intersecting each cut-out 62 at a right angle along the intermediate dimension is a pivot hole 64 and a slotted hole 66.

Coupled outboard the arm 38 and adjacent the slot 66 may be an end 68 of each push rod 40. The connection is pivotal in the same manner as the others using a pin 70, yet allows a sliding action within the slot 66. The pin 70 may be held in place by clips or snap rings 54. The opposite end of each push rod 40 is pivotally coupled to the drive mechanism 36 as shown in FIG. 2.

Fixed within each cut-out 62 are the linkage means 42 and 44. The two links 42 and 44 are pivotally interconnected at one end 74 by a pin 76. An end 78 of link 42 is coupled to the arm 38 at hole 64 by a pin 80. Similarly, an end 82 of the link 44 is coupled by the pin 70 within the slot 66. Thus the coupling of the links 42 and 44 interconnect the arm 38 and each push rod 40. The pins 70, 76 and 80 may be retained in place by c-clips or snap rings such as 54 described above, or other suitable fastening method such as brazing, welding or entrapment.

Figure 6:
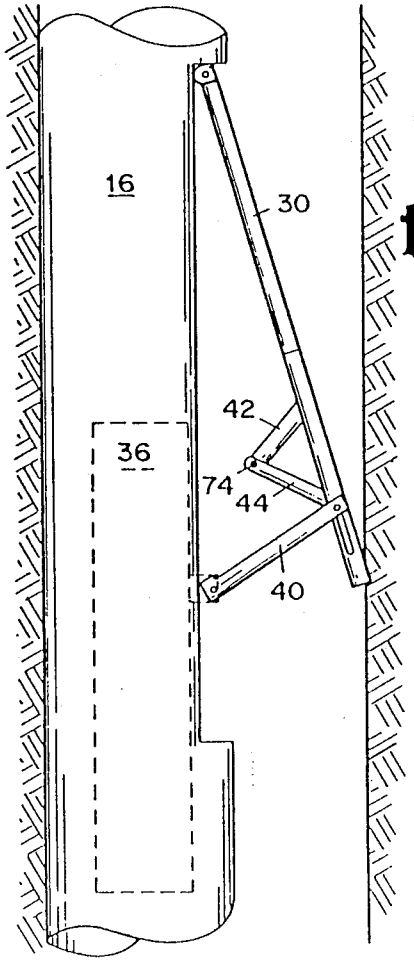
FIGS. 4–6 illustrate, in sequence, the mode of operation of this invention.
Figure 5:
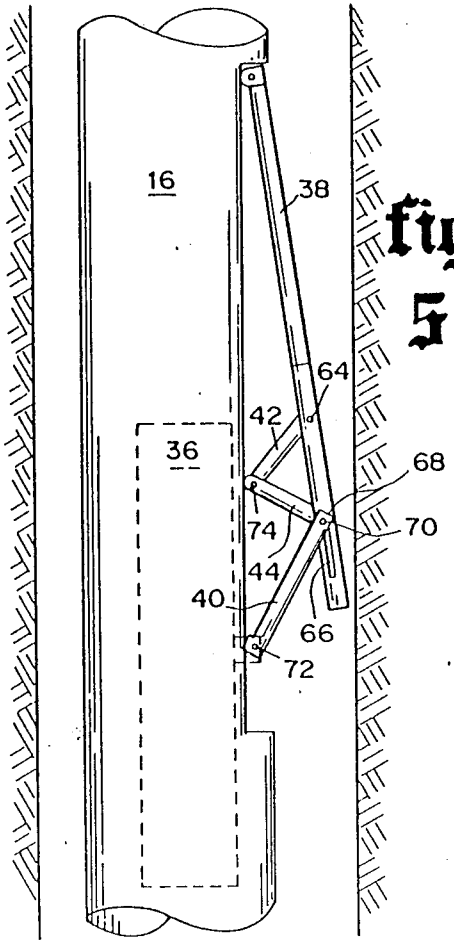
Figure 4:
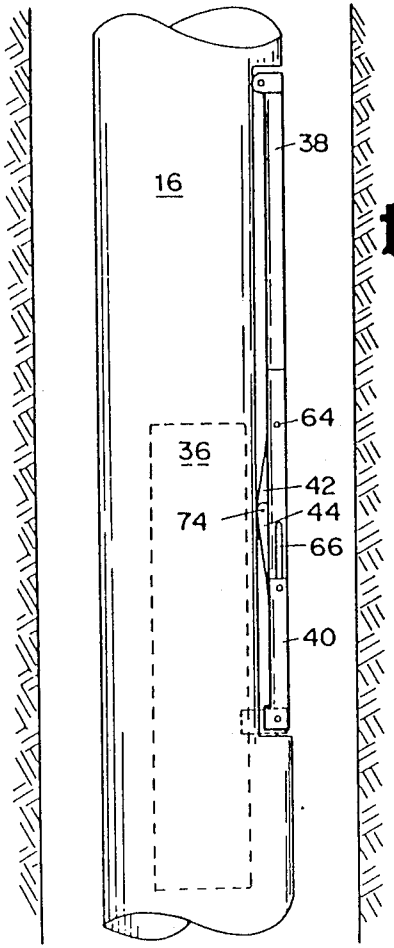

FIGS. 4–6 illustrate the mode of operation of the arm assembly 24. Referring first to FIG. 4, the arm assembly 24 is shown in the fully retracted position within the sonde 16. Note how the arm 38, the push rods 40 and the links 42, 44 are substantially flush with the sonde housing 32. Closer examination shows that the pivot point 74 is located between the sonde body 32 and the arm 38. Also note that with the arm 38 in the retracted position, the location of the connection between the arm 38 and the push rods 40 is located towards the lower end of the slot 66.

FIG. 5 illustrates the relationship between the components of the arm assembly in the early stage of extension. As the drive mechanism 36 forces the ends 72 of the push rods 40 upwards, the opposite ends 68 move upward with pin 70 in slot 66. This upward motion of the pin 70 also shortens the distance between the two ends of the links 42 and 44, thus forcing the pivot 74 or elbow against the sonde body. The force of the elbow or pivot 74 against the sonde housing 32 moves the arm away from the sonde. As the drive mechanism 36 continues to drive the lower end of the push rod upwards, the upper ends of the push rods 40 have terminated their travel within the slot 66. At this point, the upward force of the push rods act directly against the arm, causing the arm to extend until it contacts the wall of the bore hole. This is best illustrated in FIG. 6.

Reversal of the drive mechanism causes the arm to retract. The downward motion of the push rods 40 pull the pivotal connection in the slot of the arm downward. This causes the arm to move inward as the pin travels down the slot. At its termination point within the slot, the push rods pull directly upon the arm and cause the arm to withdraw within the sonde.

It should be understood that this device may have other applications than fixing bore hole tools at a desired depth. Such other applications may be in pipeline corrosion examinations, pipeline cleaning, jigging for pipe fitters and welders, etc. The device has particular application in situation where it is desirable to urge a housing of some device against the wall of a cylinder or other container, be it the earth, metal or plastic.

My invention has been described with a degree of particularity. Variations and modifications will be obvious to those skilled in the art which nonetheless fall within the scope and spirit of this invention, limited only by the appended claims, wherein

I claim as my invention:

1. An apparatus for urging a device against a wall of a container, comprising in combination:

(a) a drive means within the device;

(b) an arm pivotably coupled at one end to the device, the arm adapted to rest adjacent the device and to swing out from the device in an arc to engage the wall of the container;

(c) first means interconnecting the arm and the drive means for extending and retracting the arm along the arc with respect to the device upon actuation of the drive means; and (d) second means pivotally coupled to the arm and to the first means for exerting an initial lateral force upon the arm with actuation of the drive means, thereby extending and retracting the arm with respect to the device.

2. An apparatus for urging a housing against a wall of a bore, comprising in combination:

(a) an arm having an end pivotally coupled to said housing, said arm adapted to rest adjacent the housing and to swing out from the housing about the end to engage the wall of said bore;

(b) drive means within the housing for providing remote actuation of the arm;

(c) rod means interconnecting the arm and drive means for extending and retracting the arm with respect to the housing;

(d) linkage means disposed within the arm and actuated by the rod means, for exerting an initial lateral force upon the arm, thereby extending the arm from said housing irrespective of an orientation of the housing within the bore.

3. An arm assembly for use in an apparatus suspended within a bore hole, comprising in combination;

(a) an arm pivotally coupled at one end to the apparatus, the arm having at least one slot defined therein;

(b) drive means within the apparatus for remotely extending and retracting the arm;

(c) a push rod pivotally coupled at one end to the drive means and at an opposite end to the slot in the arm; and (d) linkage means having a first and a second link pivotally interconnected to each other at one end, a free end of the first link pivotally coupled to the arm, and a free end of the second link pivotally coupled to the push rod in sliding relationship with the slot in the arm, whereby actuation of the drive means extends and retracts the arm with a substantially constant and sufficient force to fix the apparatus within the bore hole irrespective of the orientation of the apparatus.

4. The apparatus as defined by claim 2, wherein the rod means are further comprised of a first and a second push rod, each having an end pivotally interconnected with the arm and the linkage means, and a second end pivotally coupled to the drive means.

5. The apparatus as defined in claim 2, wherein the linkage means are further comprised of a first and a second link interconnected to each other at one end, a free end of the first link pivotally coupled to the arm, and a free end of the second link pivotally coupled to, and in sliding relationship with, a slot defined within the arm.

6. The apparatus as defined in claim 2, wherein the arm has at least one cut-out portion for receiving the linkage means therein.

7. The apparatus as defined by claim 3, wherein the push rod is further comprised of a first and a second push rod, each having an end pivotally interconnected with the arm member and the linkage and a second end pivotally coupled to the drive means.

* * * * *